United States Patent [19]

Kisler

[11] Patent Number: 4,489,672

[45] Date of Patent: Dec. 25, 1984

[54] APPARATUS FOR COATING SEMICONDUCTIVE MATERIAL

[75] Inventor: Semyon Kisler, West Newton, Mass.

[73] Assignee: Polaroid Corporation, Cambridge, Mass.

[21] Appl. No.: 222,333

[22] Filed: Jan. 5, 1981

[51] Int. Cl.[3] ..... B05B 5/02; B05C 5/00

[52] U.S. Cl. ..... 118/620; 118/621; 118/626; 118/636; 118/638; 361/229

[58] Field of Search ..... 118/621, 620, 626, 636, 118/638; 361/213, 221, 229; 250/324, 325, 326

[56] References Cited

U.S. PATENT DOCUMENTS

| | | | |
|---|---|---|---|
| 2,774,921 | 12/1956 | Walkup | 250/325 |
| 3,196,270 | 7/1965 | Rosenthal | 250/324 |
| 3,474,292 | 10/1969 | Carter | 361/213 |
| 3,484,275 | 12/1969 | Lewicki | 427/10 |
| 3,671,806 | 6/1972 | Whitmore et al. | 317/2 R |
| 3,702,258 | 11/1972 | Gibbons et al. | 118/638 |
| 3,729,648 | 4/1973 | Kerr | 317/2 R |
| 4,086,872 | 5/1978 | Pan | 118/638 |
| 4,088,093 | 5/1978 | Pan | 118/638 |

OTHER PUBLICATIONS

"Controlling Polar Charge with Low Electrical Potentials", Andrews et al., Research Disclosure, Feb., 1980.

*Primary Examiner*—S. L. Childs

*Attorney, Agent, or Firm*—John J. Kelleher

[57] ABSTRACT

Excessive heat-generating current levels produced in semiconductive materials by electrostatically assisted coating apparatus employed to, for example, improve the uniformity of a coating applied to such materials are avoided by passing an auxiliary current through said semiconductive materials in the same region and in a direction opposite to that of the current produced by said electrostatically assisted coating apparatus such that the difference between the said current produced by said electrostatically assisted coating apparatus and the said auxiliary current is less than or equal to a predetermined value.

10 Claims, 4 Drawing Figures

APPARATUS FOR COATING SEMICONDUCTIVE MATERIAL

BACKGROUND OF THE INVENTION

1. Field of the Invention

The present invention relates to means for coating semiconductive materials with electrostatically assisted coating apparatus, in general, and to such apparatus for coating a moving web of such materials, in particular.

2. Description of the Prior Art

In the manufacture of various coated products it is often essential that coating materials applied to such products be of uniform thickness. In, for example, the continuous manufacture of coated photographic sheet materials, a non-uniform thickness coating applied to a moving web of said material will require considerably more drying time for drying the thicker portions of a nonuniform coating than will be required for drying the thinner portions of said nonuniform coating. In addition, a temperature gradient that is optimum for drying said thicker coating portions is often excessive for optimum drying of said thinner coating portions. Drying time is usually the major factor limiting maximum production rates of many coated products. Also, many properties of photographic film, for example, such as sensitivity to light, color saturation, etc., can be adversely affected when constructed with nonuniformly coated sheet materials.

Mechanical devices generally employed in the web coating art, such as doctor blades, scrapers and the like, have controlled the uniformity of web coating thickness to a limited degree. However, in the production of photographic film, for example, such contact devices have a propensity for inducing surface defects in the film coatings and in addition, these contact devices very often have a detrimental effect on the sensitometry of a finished photographic film product.

One of the most effective coating thickness control apparatus in present day use in the coating industry utilizes electrostatics to uniformly deposit coating materials on products to be coated. In the production of photographic film, for example, a web or sheet of material to be coated is passed between an electrically conductive support or backing roller and a coating applicator from which coating material flows onto a surface of said web. An electrostatic field is established across the gap between the coating applicator and the backing roller by a high voltage power supply whose output terminals are normally connected between said applicator and said roller. The electrostatic field causes a coating, of uniform thickness, to be deposited on the web surface to be coated, and permits larger coating gaps to be employed between said coating applicator and the material to be coated. While the voltage magnitude established between said applicator and said roller is less than that required to generate corona, said magnitude often exceeds 3KV DC.

The use of electrostatically assisted coating apparatus employing voltages in the vicinity of 3KV or more is relatively effective when coating dielectric materials or materials that have a relatively high electrical resistance. However, if such apparatus is employed to coat semiconductive materials, excessive heat-generating current levels could result because of the lower electrical resistance of such materials, and this excessive heat would have a detrimental effect on the quality of such materials. The greater the conductivity of the semiconductive materials, the greater the magnitude of harmful heat-producing current that would be generated for any given level of electrostatic assist.

SUMMARY OF THE INVENTION

In accordance with the teachings of the present invention, a method and device are disclosed that will coat semiconductive materials with electrostatically assisted coating apparatus at higher electrostatic assist potentials without producing heat-generating current levels that could damage such materials. Excessive heat levels are precluded and higher coating gap potential can be achieved when electrostatically assisted coating apparatus is employed to coat semiconductive materials, by passing an auxiliary current through said semiconductive materials during the coating process in the same region and in a direction opposite to that of the current produced by the electrostatically assisted coating apparatus such that the difference between the said current produced by said electrostatically assisted coating apparatus and the said auxiliary current is less than or equal to a predetermined value.

DESCRIPTION OF THE PREFERRED EMBODIMENT

Figure 1:
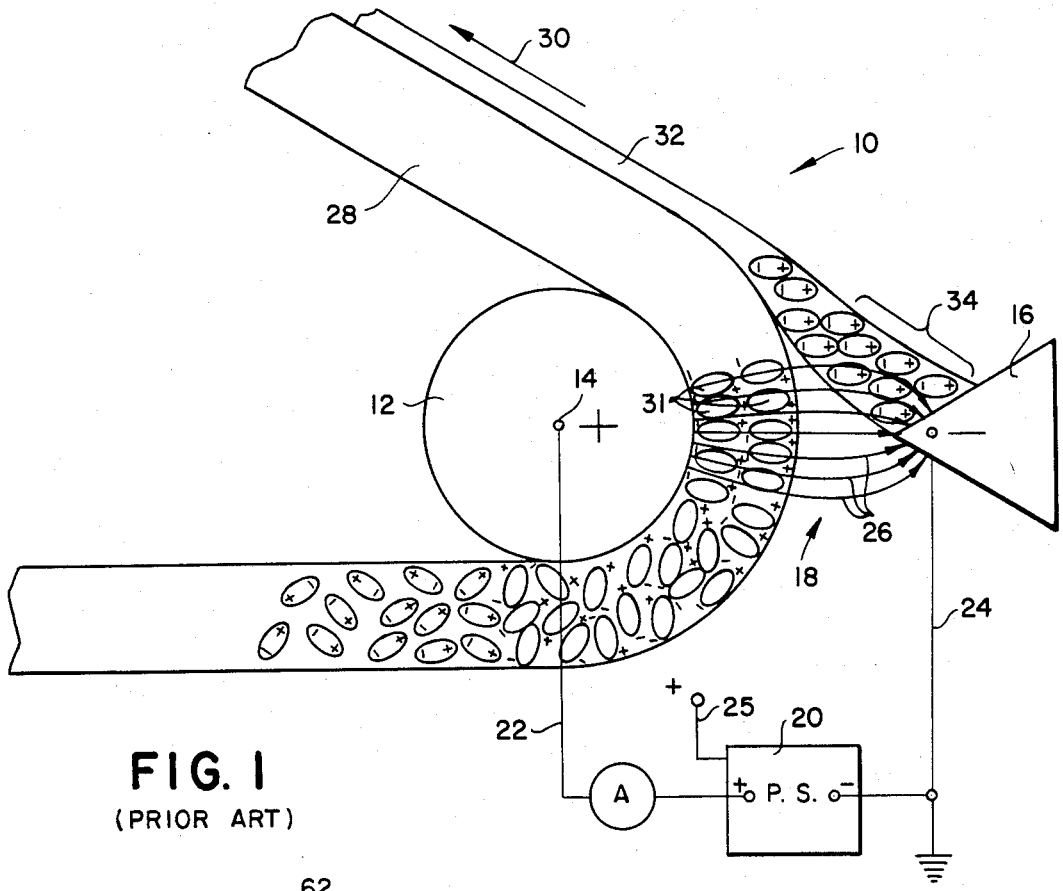
FIG. 1 (PRIOR ART)
FIG. 1 is a schematic diagram of web coating apparatus employing an electrostatic coating-gap assist technique in accordance with teachings of the prior art.

To facilitate understanding the inventive concept of the present invention, electrostatic coating-gap assist apparatus representative of the type generally employed in the prior art for coating dielectric or insulative materials will be described before a description of the present invention is initiated. Referring now to the drawings, in FIG. 1 numeral 10 generally indicates web coating apparatus employing electrostatic coating-gap assist apparatus constructed in accordance with the teachings of the prior art. FIG. 1, web support or backing roller 12 is cylindrically shaped, is electrically conductive and is mounted for rotation about backing roller axis 14. Coating applicator 16 is mounted in a fixed position with respect to backing roller 12 and is spaced from said roller 12 by distance or gap 18. High voltage supply 20, having a DC voltage across its output terminals that is often in the neighborhood of several thousand volts, has said output terminals connected between backing roller 12 and applicator 16 through paths 22 and 24, respectively. Because the coating fluid applied by applicator 16 maintains said applicator 16 at or near ground potential through a conduit (not shown) supplying coating fluid to said applicator 16, the high voltage terminal of power supply 20 is connected to said roller 12 and the low voltage terminal of said supply 20 is connected to said grounded applicator 16.

When power supply 20 is energized through paths 25, electrostatic field 26 is produced in coating gap 18 between high potential backing roller 12 and grounded applicator 16. As insulative or dielectric web material 28 is moved in direction 30 through gap 18 by drive means (not shown), said web 28 is electrostatically charged by orienting its dipoles (such as dipoles 31) by means of said electrostatic field 26. The electrostatic charge produced on web 28 by electrostatic field 26 causes fluid 32 flowing from applicator 16 into coating gap 18 to be attracted toward and uniformly deposited on said moving web 28.

An extremely important factor in the web coating process is the maintenance of a proper amount of coating material 32 in gap 18 for proper web-coating purposes. This porion of coating material 32 is sometimes referred to as a coating fluid bead and is designated numeral 34 in prior art FIG. 1. The surface of web 28 that is to be coated moves faster than the rate at which coating fluid 32 moves onto said web 28 surface. This being so, as web 28 and fluid 32 in the form of bead 34 are brought into contact with one another, the faster moving web 28 pulls and thereby stretches said fluid 32 causing the thickness of coating fluid 32 to be reduced to a desired level. It is believed the electrostatic field 26 changes properties of coating fluid 32 such surface tension allowing fluid 32 to be stretched to a greater degree and over a large gap between web 28 and applicator 16 without losing or breaking bead 34 than would be possible if electrostatic gap-assisting field 26 were not present. In addition to its primary contribution of providing the desired coating layer thickness on web 28, gap 18 in FIG. 1 must be large enough to accommodate such things as web splices or foreign matter so that said splices or matter do not come into contact with applicator 16 and thereby adversely affect web coating thickness and/or surface quality.

Figure 2A:
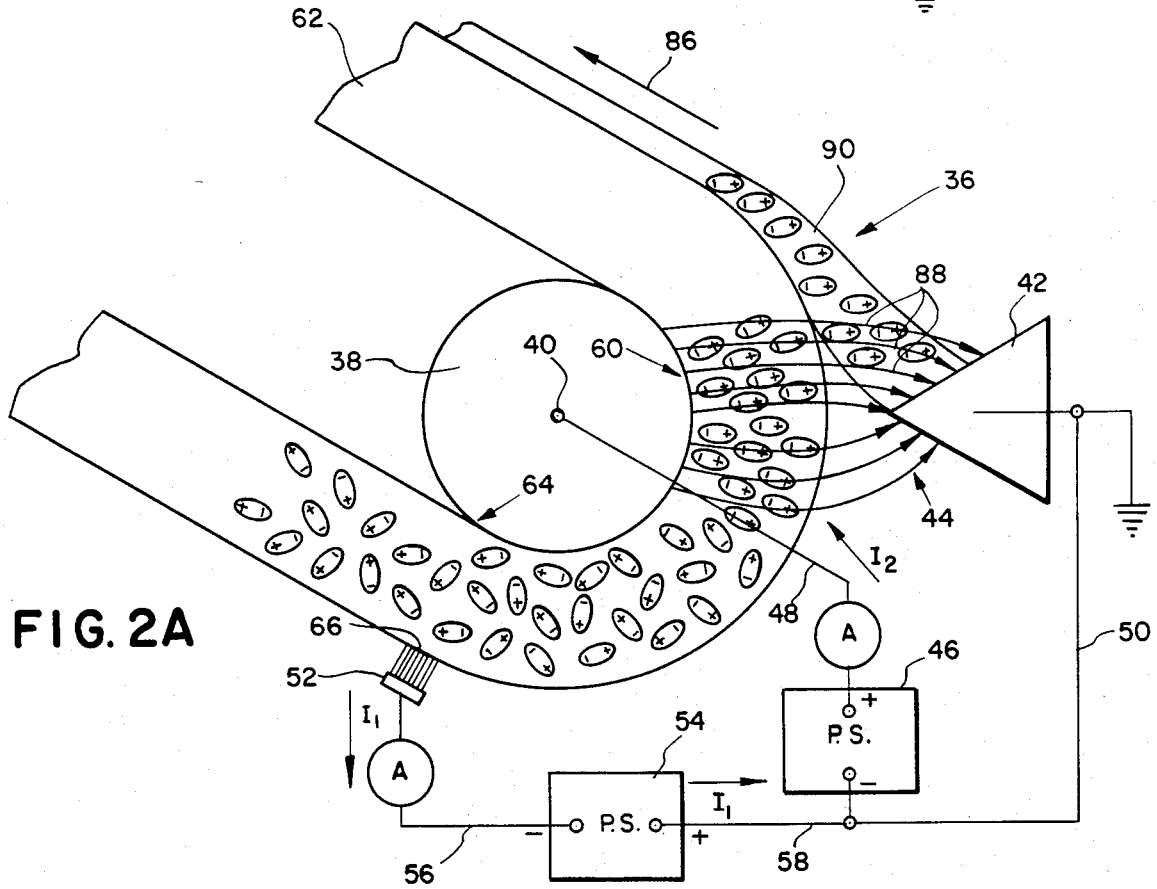
FIG. 2A is a schematic diagram of apparatus for coating semiconductive materials employing an electrostatic coating-gap assist technique in accordance with the present invention.
Figure 3:
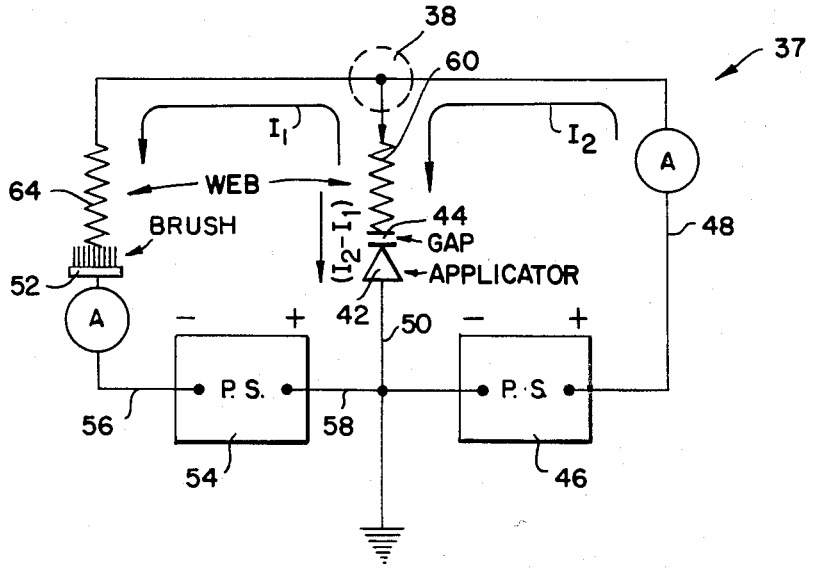
FIG. 3 is an electrical circuit analog of the electrostatic coating-gap assist apparatus schematically illustrated in FIG. 2A.

Turning now to the present invention, and specifically to FIGS. 2A and 3, in FIG. 2A numeral 36 generally indicates web coating apparatus for coating wet or semiconductive materials. FIG. 2A is a schematic diagram of apparatus that employs electrostatic coating-gap assist apparatus constructed in accordance with said present invention. FIG. 3 schematically depicts electrical circuit analog 37 of the electrostatic coating-gap assist apparatus that is schematically illustrated in said FIG. 2A. In FIG. 2A, web support or backing roller 38 is cylindrically shaped, is electrically conductive and is mounted for rotation about backing roller axis 40. Coating applicator 42 is mounted in a fixed position with respect to backing roller 38 and is spaced for said roller 38 by distance or gap 44. Primary high voltage supply 46, having a DC voltage across its output terminals that is often in the neighborhood of several thousand volts, has said output terminals connected between backing roller 38 and applicator 42 through paths 48 and 50, respectively. Backing roller 38 and applicator 42 are also referred to herein as electrodes when, for example, they are so connected to said power supply 46. Power supply 46 is a relatively high impedance device in that by itself it has no significant effect on the impedance of any electrical circuit connected between its said high voltage output terminals. As noted above, because the coating fluid supplied by applicator 42 maintains said applicator 42 at or near ground potential through conduit (not shown) supplying coating fluid to said applicator 42, the high voltage terminal of power supply 46 is necessarily connected to said roller 38 and the low voltage terminal of said supply 46 is connected to said grounded applicator 42.

Conductive bristle brush 52 is mounted in a fixed position with respect to and has the free ends of its bristles pointed toward and spaced from said grounded backing roller 38. Brush 52 is also referred to herein as a third electrode. DC power supply 54 has its high voltage output terminal connected to one end of each of the bristles of said conductive bristle brush 52 through path 56 and has its low voltage output terminal connected to applicator 42 through paths 58 and 50. Power supply 54 is also a relatively high impedance device in that by itself it has no significant effect on the impedance of any electrical circuit connected between its said high voltage output terminal.

Portion 60 of semiconductive web 62 is supported in gap 44 in a spaced relation from applicator 42 by web backing roller or support means 38. Portion 64 of said web 62 is supported by said backing roller 38 such that outer surface 66 of said web portion 64 is in direct physical contact with the free ends of the conductive bristles of brush 52. The function of brush 52 is to provide a moving or sliding electrical contact between surface 66 of web portion 64 and the high voltage output terminal of auxiliary power supply 54 through path 56 and said brush 52. Other moving contact arrangements may be substituted for that provided by brush 52. One such moving contact arrangement may take the form of that shown in FIG. 2B.

Figure 2B:
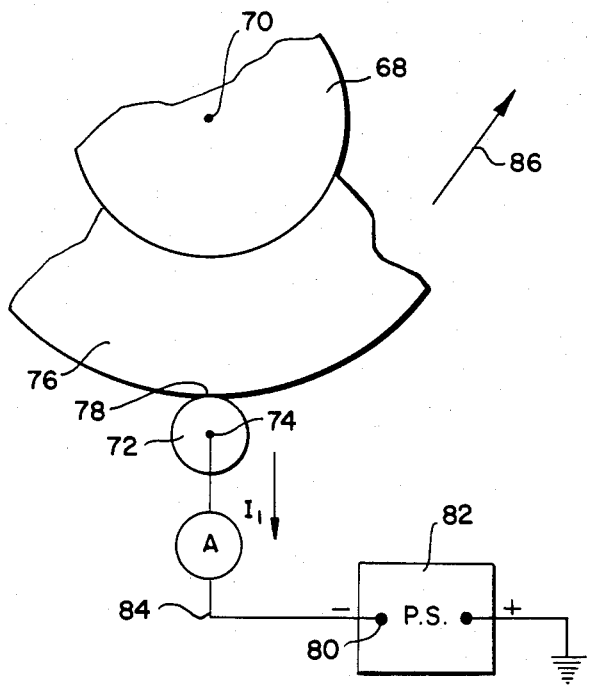
FIG. 2B is a schematic diagram of an alternate device that may be substituted for the auxiliary current providing conductive bristle brush of FIG. 2A.

Turning momentarily to FIG. 2B, electrically conductive web support or backing roller 68 of cylindrical shape is mounted for rotation about backing roller axis 70. Conductive rubber roller 72, which would be considered a third electrode herein if employed in place of brush 52, is mounted for rotation about axis 74 and is spaced from web support roller 68. A portion of web 76 is supported between rollers 68 and 72 such that one surface of web 76 is in contact with roller 68 and another or the outer surface 78 of web 76 is in contact with conductive rubber roller 72. High voltage output terminal 80 of auxiliary DC power supply 82 is connected to surface 78 of web 76 through conductive rubber roller 72 that is connected to said terminal 80 through conductive path 84. When web 76 is moved in direction 86 between rollers 68 and 72, said roller 72 rotates about axis 74 to thereby provide a moving contact between surface 78 of web 76 and said conductive rubber roller 72.

Another less desirable arrangement may take the form of an electrically conductive path between the high voltage terminal of power supply 54 and backing roller 38 in FIG. 2A that includes a resistor whose resistance value is equivalent to the electrical resistance of portion 64 of semiconductive web 62 that is presented to said power supply 54. This electrically conductive path together with said resistor would be considered a third electrode herein if employed in place of brush 52. An advantage of this arrangement is that said equivalent resistor can be selected such that it has a larger wattage or heat rating than porion 64 of said web 62.

Returning now to FIGS. 2A and 3 and the preferred embodiment of the present invention illustrated therein, when power supplies 46 and 54 are energized while portion 60 of semiconductive web 62 is between roller 38 and applicator 42, and while portion 64 of said web 62 is between said roller 38 and the free ends of conductive bristle brush 52, as described in detail above, electrical currents $I_1$ and $I_2$ produced by power supplies 54 and 46, respectively, pass through portions 60 and/or 64 of said web 62. Current $I_2$ flows from primary power supply 46 to web support or backing roller 38 through electrically conductive path 48, through portion 60 of semiconductive web 62, across gap 44 into grounded coating applicator 42 and then back to the low potential side of said primary power supply 46 through electrically conductive path 50. At the same time that current $I_2$ is flowing from primary power supply 46 in the above described manner, current $I_1$ is flowing from auxiliary power supply 54. Current $I_1$ flows from the low voltage terminal of auxiliary power supply 54 to grounded applicator 42 through conductive paths 58 and 50, across gap 44, through portion 60 of semiconductive web 62 in a direction opposite to current $I_2$ that is flowing from power supply 46, through conductive support or backing roller 38, through portion 64 of semiconductive web 62 and then back to the high potential side of power supply 54 through the sliding contact provided by brush 52, and electrically conductive path 56. The magnitude of current $I_1$ to be supplied to portion 60 of semiconductive web 62 by auxiliary power supply 54 is primarily though indirectly determined by the conductivity of semiconductive material 62. Ideally, the effective current passing through portion 60 of web 62 should be zero which means current $I_1$ from auxiliary power supply 54 should be exactly equal in magnitude and opposite in direction to current $I_2$ flowing from primary power supply 46, a magnitude that is primarily determined by web 62 conductivity. However, as a practical matter the magnitude of current $I_1$ is empirically determined by such things as the desired electrical potential level on backing roller 38 and/or portion 60 of web 62 by differential current $I_2$ minus $I_1$. Current $I_2$ is dependent upon the conductivity of web 62 and the magnitude of current $I_1$ is adjusted until it approximates current $I_2$. Obviously, if current $I_2$ were not opposed by current $I_1$, excessive semiconductive-web 62-damaging heat would be generated because of the low electrical resistance (relatively high conductivity) offered to current $I_2$ in the gap between applicator and backing roller by said semiconductive-web 62, for the desired level of voltage-dependent electrostatic assist. In many semiconductive material coating applications the heat generated by a differential current ($I_2$-$I_1$) of up to 5ma is acceptable. As web 62 moves in direction 86 through gap 44, and electrostatic field 88 in said gap 44, coating fluid 90 from coating applicator 42 is uniformly deposited on semiconductive web 62 with the aid of the assisting forces provided by electrostatic field 88.

DISCUSSION

A low electrical impedance in coating gap 44 in the semiconductive material coating apparatus of FIG. 2A will normally cause the potential on backing roller 38 in said FIG. 2A to be maintained at a level that is substantially below that necessary for effective coating-gap assist. By directing currents $I_1$ and $I_2$ through gap 44 in opposite directions with respect to one another the electrical impedance of gap 44 is increased thereby enabling higher gap assisting electrical potentials to be employed in, for example, said backing roller 38.

The magnitude of electrostatic field 88 in coating gap 44 of FIG. 2A and the coating assisting forces produced by said field 88 are primarily dependent upon the voltage across and not the current through said gap 44. Therefore, when auxiliary current $I_1$ is passed through portion 60 of semiconductive web 62 in a direction opposite to that of primary power supply current $I_2$ in order to neutralize the effects that would otherwise be produced in web 62 by said current $I_2$ if it were not so neutralized by said current $I_1$, a desired voltage differential in the vicinity of 3KV DC or more can be maintained across gap 44 in order to generate a coating assisting electrostatic field in said gap 44, and without causing excessibe current-related heat to be produced in semiconductive web 62.

The term semiconductive material employed herein when describing the preferred embodiment of the present invention encompasses an extremely wide range of material resistances. Semiconductive materials are normally considered those that have an electrical resistance greater than that of a pure conductor but less than $1\times10^{10}$ ohms. However, the actual ohmic value of the material to be coated is not the controlling factor. The primary considerations are the desired voltage level across the coating gap and/or the level of heat that would be produced in the semiconductive material for any given level of coating gap voltage. The lower the semiconductive material resistance the higher the magnitude of current-related heat that will be produced without an auxiliary current and the higher must be the magnitude of said auxiliary current to neutralize the effects of such heat.

Power supplies 46 and 54 have bee described above in the preferred embodiment of the present invention as two separate power supplies. However, a single power supply capable of supplying the currents and voltages provided by power supplies 46 and 54 may also be utilized.

When a potential difference is established between backing roller 38 and applicator 42 in, for example, FIG. 2A, said roller 38 and said applicator 42 are sometimes referred to herein as electrodes.

The term "electrostatic field" employed herein means one species of electric field.

It will be apparent to those skilled in the art from the foregoing description of my invention that various improvements and modifications can be made in it without departing from its true scope. The embodiments described herein are merely illustrative and they should not be viewed as the only embodiments that might encompass my invention.

What is claimed is:

1. Apparatus for applying an operational electric field to a given surface of semiconductive material, the apparatus comprising a first electrode spaced from a given point on said given surface, a second electrode located in adjoining relation to the opposite surface of said material, means when energized for applying a direct current potential difference between said electrodes, causing a current flow through said given point in a given direction in said semiconductive material, the improvement comprising:

a third electrode located in adjoining relation to said material; and means, when energized for applying a direct current potential difference between said first and third electrode of opposite polarity to the potential difference between said first and second electrode to produce a current flow in a direction opposite said given direction and of a magnitude to reduce the net current flow through said material at said one point.

2. The improvement of claim 1 wherein said third electrode is sufficiently spaced from said one point as to substantially avoid interference with the field produced thereat by said first and second electrodes.

3. The improvement of claims 1 and 2 wherein said third electrode is located in adjoining relation to said given surface.

4. Apparatus for coating semiconductive material, comprising:

a coating applicator for depositing a coating fluid on said semiconductive material;

means for supporting a portion of said material in a spaced relation from said coating applicator;

means for establishing an electric field between said applicator and said material support means that causes a current to flow through the space between said support means and said applicator in a given direction;

an auxiliary electrical current source; and means for passing a current from said auxiliary current source through said space between said support means and said applicator in a direction that is opposite to the said given direction of current produced by said electric field in said semiconductive material when said semiconductive material is moved through said electric field between said applicator and said support means, the difference between the magnitude of the current produced by said electric field and the magnitude of the current produced by said current source being less than or equal to a predetermined value.

5. The apparatus of claim 4, wherein said means for supporting a portion of said semiconductive material is a rotatably mounted, electrically conductive backing roller.

6. The apparatus of claim 4, wherein said material support means is a rotatably mounted, electrically conductive backing roller and said means for passing a current from said auxiliary current source through the said space between said support means and said applicator includes a conductive bristle brush connected to said auxiliary current source that provides a sliding contact between said current source and a surface of the semiconductive material to be coated when a portion of said material is maintained in contact with the free ends of the bristles of said brush by said backing roller as said material is moved toward said electric field between said backing roller and said applicator for coating purposes.

7. The apparatus of claim 4, wherein said material support means is a rotatably mounted, electrically conductive backing roller and said means for passing a current from said space between said support means and said applicator includes a rotatably mounted conductive rubber roller connected to said auxiliary current source that provides a rolling contact between said current source and a surface of the semiconductive material to be coated when a portion of said material is maintained in contact with the outer surface of said rubber roller by said backing roller as said material is moved toward said electric field between said backing roller and said applicator for coating purposes.

8. The apparatus of claim 4, wherein said electric field between said applicator and said support means is established by establishing an electrical potential difference between said applicator and said material support means, and the potential of said applicator is more positive potential than the potential of said support means.

9. The apparatus of claim 4, wherein said electric field between said applicator and said support means is established by establishing an electrical potential difference between said applicator and said material support means and said support means is at a more positive potential than said applicator.

10. The apparatus of claim 4, wherein said electric field is an electrostatic field.

* * * * *